US007329847B2

(12) United States Patent
Tatsumu et al.

(10) Patent No.: US 7,329,847 B2
(45) Date of Patent: Feb. 12, 2008

(54) COMBINATION MICROWAVE AND IMPINGEMENT HEATING COOKING OVEN

(75) Inventors: Norikimi Tatsumu, Osaka (JP); Yuzi Andoh, Nara (JP); Tetsuichi Arita, Osaka (JP); Masayuki Iwamoto, Osaka (JP); Shinya Ueda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/561,910

(22) Filed: Nov. 21, 2006

(65) Prior Publication Data

US 2007/0108199 A1 May 17, 2007

Related U.S. Application Data

(62) Division of application No. 10/499,355, filed on Jan. 6, 2005.

(30) Foreign Application Priority Data

Dec. 28, 2001 (JP) ..... 2001-400793
Apr. 9, 2002 (JP) ..... 2002-106821
Dec. 24, 2002 (WO) ..... PCT/JP02/13459

(51) Int. Cl.
*H05B 6/80* (2006.01)
*F27D 11/00* (2006.01)

(52) U.S. Cl. ..... 219/681; 219/400; 219/746; 219/757; 126/21 A

(58) Field of Classification Search ..... 219/680–682, 219/685, 757, 746, 748, 400; 126/21 A, 126/21 R See application file for complete search history.

(56) References Cited

U.S. PATENT DOCUMENTS 4,332,992 A * 6/1982 Larsen et al. ..... 219/681

(Continued)

FOREIGN PATENT DOCUMENTS

GB 2 237 487 A * 5/1991

(Continued)

OTHER PUBLICATIONS

International Search Report for corresponding PCT/JP02/13459, mailed Dec. 24, 2002.

*Primary Examiner*—Philip H. Leung
(74) *Attorney, Agent, or Firm*—Renner, Otto, Boisselle & Sklar, LLP

(57) ABSTRACT

A combination microwave and impingement heating cooking oven, wherein an upper blowing port blowing hot air in vertical direction and a lateral blowing port for blowing hot air in horizontal direction are provided in a cooking chamber, the upper blowing port is provided in the ceiling wall of the cooking chamber, the lateral blowing port is provided in one of the right and left inside walls thereof, and a suction port is provided in the bottom inside wall thereof in the form of collected perforations, air in the cooking chamber sucked from the suction port is fed to an upper duct and a lateral duct, heated by an upper heater and a lateral heater, respectively, and blown from the upper blowing port and the lateral blowing port, and the distribution of the perforations of the upper blowing port is made such that the distribution of the perforations at a position where the air blows toward air current from the lateral blowing port to a cooked object is made coarser than that at the other positions so that the air current in horizontal direction cannot be obstructed, and a wave feed port for discharging microwaves into the cooking chamber is so arranged as not to directly face the lateral blowing port.

4 Claims, 15 Drawing Sheets

U.S. PATENT DOCUMENTS

| | | | | |
|---|---|---|---|---|
| 4,831,227 | A * | 5/1989 | Eke | 219/681 |
| 2001/0032840 | A1* | 10/2001 | Kim et al. | 219/681 |

FOREIGN PATENT DOCUMENTS

| | | |
|---|---|---|
| JP | 56-50915 | 9/1954 |
| JP | 56-151802 | 4/1955 |
| JP | 58-185125 | 10/1983 |
| JP | 58-221335 | 12/1983 |
| JP | 62-162502 | 10/1987 |
| JP | 64-8111 | 1/1989 |
| JP | 3-144219 | 6/1991 |
| JP | 2000-329351 | 11/2000 |
| JP | 2001-311518 | 11/2001 |
| JP | 2003-214398 | 7/2003 |

* cited by examiner

COMBINATION MICROWAVE AND IMPINGEMENT HEATING COOKING OVEN

This application is a divisional application of U.S. patent application Ser. No. 10/499,355 filed on Jan. 6, 2005, which is hereby incorporated herein by reference in its entirety.

TECHNICAL FIELD

The present invention relates to a cooking oven for cooking foods with heat by applying thereto a hot air stream or a hot air stream combined with a microwave.

BACKGROUND ART

Cooking ovens such as convection ovens and hot-air-impingement ovens that cook foods with heat by forming a circulated current of hot air stream inside a cooking chamber in which the foods are placed, are well known and widely used. Published documents such as, to name a few, Japanese Utility Model Published No. H6-23841 and Japanese Patent Applications Laid-Open Nos. H9-145063, H11-166737, 2000-329351, and 2001-311518 disclose examples of hot-air-circulation cooking ovens. On the other hand, Japanese Patent Published No. H9-503334 discloses an example of a hot-air-impingement cooking oven. Cooking ovens that combine a hot air stream with microwave heating are also well known (see Japanese Patent Applications Laid-Open Nos. H9-145063, H11-166737, and 2001-311518).

Now, as the basis of the present invention, the construction of a hot-air-circulation cooking oven will be described with reference to FIGS. 15 to 17. FIG. 15 is a front view of the cooking oven, FIG. 16 is a vertical sectional view thereof, and FIG. 17 is a perspective view showing the construction of a microwave heating device. The cooking oven 1 has a cabinet in the shape of a rectangular parallelepiped. Inside the cabinet 10, there is formed a cooking chamber 11 in the shape of a rectangular parallelepiped. The top and bottom of the cooking chamber 11 are formed by a ceiling wall 12 and a floor wall 13, respectively. Of the four sides of the cooking chamber 11, three are formed by a rear inner wall 14, a left inner wall 15, and a right inner wall 16, respectively, and the fourth side consists of an freely openable door 17. The door 17 and all the walls of the cooking chamber 11 are heat-insulated.

The cooking chamber 11, which is enclosed from six sides by the walls and the door as described above, has the following interior dimensions: 230 mm high, 408 mm wide, and 345 mm deep. It should be understood that all the values given as dimensions, speeds, temperatures, and the like in the present specification are merely preferable examples and are not meant to limit the scope of the present invention in any way.

Outside the rear inner wall 14, there is installed a blower 20. The blower 20 has a centrifugal fan 22 arranged inside a fan casing 21. This centrifugal fan 22 is rotated in the forward and backward directions by a reversible-rotation motor, which will be described later. The fan casing 21 is of a type that branches into two directions, and has an upper discharge port 23 and a side discharge port 24. The upper discharge port 23 connects to an upper duct 25 provided outside the ceiling wall 12. The side discharge port 24 connects to a side duct 26 provided outside the left inner wall 15.

The upper duct 25 has an upper blowout port 30 open to the cooking chamber 11. The side duct 26 has a side blowout port 31 open to the cooking chamber 11. In the rear inner wall 14, there is formed a suction port 32 of the blower 20. The upper blowout port 30 consists of a group of small cylindrical holes each 11 mm across. The side blowout port 31 and the suction port 32 are each formed by a group of perforations each 5 mm across.

As shown in FIG. 16, in the upper duct 25 is provided an upper heater 40. In the side duct 26 is provided a side heater 41. Outside the right inner wall 16, there are arranged a microwave heating device 42 that assists the heating by the upper and side heaters 40 and 41 and a controller 43 that controls the operation of the cooking oven 1 as a whole. On the outer front surface of the right inner wall 16, there is provided an operation panel 44 (see FIG. 15) that accepts instructions for the controller 43.

On the floor wall 13, there is arranged a turntable 50 on which to place foods. On the turntable 50 is placed a supporting means such as a grill or rack that suits the kind of food placed. Reference number 51 represents a turntable drive motor.

Outside the cooking chamber 11, there are arranged components as shown in FIG. 17. The microwave heating device 42, of which the existence is only abstractly illustrated in FIG. 16, is illustrated as a concrete component in FIG. 17.

The core component of the microwave heating device 42 is a microwave generating device 70. The microwave generating device 70 is realized with a magnetron, which is oscillated by a high-voltage transformer 71. The microwave generated by the microwave generating device 70 is fed by way of a waveguide 72 to a side wall of the cooking chamber 11, and is then discharged from a wave feed port 73 into the cooking chamber 11. For the microwave generating device 70 is provided a cooling fan 74. For the high-voltage transformer 71 is provided a cooling fan 75. On the back-face side of the cooking chamber 11, there is arranged a reversible-rotation motor 80 for rotating the centrifugal fan 22 in the forward or backward direction.

The cooking oven 1 operates as follows. First, the door 17 is opened. Then, among different types of supporting means such as grills and racks, one that suits the intended kind of food is placed on the turntable 50. On this supporting means, foods are placed directly or using a container. Then, the door 17 is closed.

After the door 17 is closed, cooking conditions are entered via the operation panel 44. Based on the thus entered cooking conditions, the controller 43 selects the optimum among a plurality of pre-programmed cooking methods. The controller 43 then drives the blower 20, upper heater 40, side heater 41, microwave heating device 42, and turntable drive motor 51 to start cooking.

For example, in a case where roasted chicken is prepared, a grill is placed on the turntable 50, and a chunk of meat is placed on the grill. Then, the door 17 is closed, and then, from the menu displayed on the operation panel 44, "roasted chicken" is selected. Now, the controller 43 operates the blower 20, upper heater 40, side heater 41, microwave heating device 42, and turntable drive motor 51 in a mode for preparing "roasted chicken."

The upper heater 40 has a power rating of 1,700 W, and the side heater 41 has a power rating of 1,200 W. Out from each of the upper blowout port 30 and the side blowout port 31 blows a hot air stream having a temperature of 300° C. or more as measured at those ports. The controller 43 controls the blower 20 in such a way that the air stream blown out from the upper blowout port 30 has a air stream speed of 65 km/h or more, and that the air stream blown out from the side blowout port 31 has a air stream speed of 30 km/h or less. The turntable 50 is rotated at a rotation rate of 6 rpm.

In the case described above, cooking is achieved by a hot-air-impingement method whereby a high-speed hot air stream is blown onto the foods. This permits fast cooking of the chunk of meat. The temperature inside the cooking chamber 11 is automatically adjusted at the target temperature entered via the operation panel 44. The upper limit of the target temperature is 300° C.

Next, how sponge cake is prepared will be described. A rack is placed on the turntable 50. Then, dough to be cooked into sponge cake is placed on the turntable 50 and also on the rack. The door 17 is closed, and, from the menu displayed on the operation panel 44, "sponge cake" is selected. Now, the controller 43 operates the blower 20, upper heater 40, side heater 41, microwave heating device 42, and turntable drive motor 51 in a mode for preparing "sponge cake." Also here, the turntable 50 is rotated at a rotation rate of 6 rpm.

Here, however, the controller 43 controls the blower 20 in such a way that a hot air stream having a air stream speed of 30 km/h or less blows out from the upper blowout port 30, and that a hot air stream having a air stream speed of 40 km/h or less blows out from the side blowout port 31. In this case, cooking is achieved by two-stage hot-air-circulation method, and this permits the dough placed on the turntable 50 and on the rack to be each cooked into fluffy sponge cake. The hot air stream that blows from above has a low speed, and thus does not deform by its pressure the dough in the process of rising.

In cooking, a hot air stream or a microwave may be used singly, or they may be generated simultaneously so that heating is achieved by their combined effect. Whether to use the effect of a hot air stream or a microwave alone or their combined effect is determined by a cooking program or through selection by the user.

The cooking oven 1 described above can cope with various kinds of food and various methods of cooking by adjusting the ratio of the volumes of air stream blown out by the blower 20, the volumes of air stream themselves, and the air stream speeds, and by adjusting the amounts of heat generated by the upper and side heaters 40 and 41 and the output of the microwave heating device 42.

The cooking oven 1 described above blows a hot air stream onto foods 60 from above as shown in FIG. 18, and blows a hot air stream onto it also from a side as shown in FIG. 19. In a case where, as shown in FIGS. 18 and 19, a grill 61 is placed on the turntable 50 so that foods 60 are held up in the air, to heat the bottom face of foods sufficiently, it is essential that a hot air stream be blown from a side. However, blowing out hot air streams simultaneously in vertical and horizontal directions causes the following problem.

By design, the hot air stream that is blown out in the horizontal direction from the side blowout port 31 is expected to form a powerful air stream that blows through up to the suction port 32 as indicated by arrow W in FIG. 20. This permits a sufficient amount of heat to be transmitted to the bottom face of the foods 60. Here, however, when a hot air stream is also blowing out in the vertical direction from the upper blowout port 30, it deflects the hot air stream blown out in the horizontal direction from the side blowout port 31 and weakens the power of this air stream with which it blows through along the bottom face of the foods 60. This makes it hard to transmit a sufficient amount of heat to the bottom face of the foods 60. This tendency is more striking when cooking is performed by a hot-air-impingement method by using a hot air stream that blows down from above at a high speed.

When a hot air stream is blown out from the side blowout port 31 onto foods 60 while it is being rotated by the turntable 50, consideration needs to be given also to the following phenomenon. The part of the foods 60 located at the center of rotation of the turntable 50 receives the hot air stream all the time. By contrast, the part of the foods 60 located off the center of rotation receives less of the hot air stream when it happens to be located away from the position where it faces the side blowout port 31. This results in uneven cooking of the foods 60 from one part of it to another.

Moreover, with respect to the microwave heating device 42, the following problem arises. The wave feed port 73 is covered with a cover such as a punched metal sheet or metal mesh. If the wave feed port 73 is not located appropriately, this cover is sprinkled with oil and food fragments blown off from the foods by the hot air stream. As such pollutants accumulate on the surface of the cover, they may start fire or invite electrical discharge by the microwave.

DISCLOSURE OF THE INVENTION

An object of the present invention is, in a cooking oven whose cooking chamber is provided with an upper blowout port through which a hot air stream is blown out in a vertical direction and a side blowout port through which a hot air stream is blown out in a horizontal direction, to prevent the vertical-direction air stream from hindering the horizontal-direction air stream, and to prevent pollutants from settling and accumulating at a wave feed port through which a microwave is introduced.

To achieve the above object, according to the present invention, a cooking oven is constructed as follows. The cooking oven has a blowout port and a suction port for passage of a hot air stream formed inside a cooking chamber to form a circulation of hot air stream so that foods are cooked with heat by the circulating air stream. In this cooking oven, an upper blowout port is formed in the ceiling wall of the cooking chamber, and a side blowout port is formed in one of the inner side walls forming the four sides of the cooking chamber. A suction port is formed in one of the inner side walls other than the inner side wall in which the side blowout port is formed. The upper blowout port is so arranged that the air stream that blows out therefrom does not deflect downward the air stream that blows from the side blowout port to the foods. This permits the hot air stream from the upper blowout port to blow out chiefly toward elsewhere than where the air stream that flows from the side blowout port to the foods is flowing, and thus the hot air stream from the side blowout port is not hindered. In this way, the hot air stream from the upper blowout port does not deflect downward the hot air stream from the side blowout port. As a result, the hot air stream from the side blowout port flows along the designed route and reaches the foods, transmitting a required amount of heat to a required portion of the foods. Thus, the hot air stream from the side blowout port can play its expected role satisfactorily, contributing to enhanced quality of the cooked target. This effect is striking particularly in cooking employing a hot-air-impingement method whereby a high-speed hot air stream is blown down from above.

According to the present invention, in the cooking oven constructed as described above, the openness of the upper blowout port is adjusted as follows. The openness of the upper blowout port is made smaller in a portion thereof from which the air stream blows out toward the air stream that blows from the side blowout port to the foods blows out than in the other portion thereof. This prevents the air stream that blows from the side blowout port to the foods from being deflected downward. That is, by adjusting the openness of the upper blowout port, it is possible to achieve the effect of preventing the air stream that blows from the side blowout port to the foods from being deflected downward. This construction is easy to realize.

According to the present invention, in the cooking oven constructed as described above, the upper blowout port consists of a plurality of perforations, and these small hoes are distributed as follows. The distribution of the perforations of the upper blower port is sparser in a portion thereof from which the air stream blows out toward the air stream that blows from the side blowout port to the foods than the other portion thereof. This makes it possible to produce the aforementioned difference in the openness of the upper blowout port. With this construction, even if the perforations have a uniform diameter, by adjusting their distribution, it is possible to produce a difference in openness, and thereby to achieve the effect of preventing the air stream that flows from the side blowout port to the foods from being deflected downward. This construction is easy to realize.

According to the present invention, a cooking oven is constructed as follows. The cooking oven has a blowout port and a suction port for passage of a hot air stream formed inside a cooking chamber to form a circulation of hot air stream so that foods are cooked with heat as a result of a turntable on which the foods are placed being rotated in the circulating air stream. In this cooking oven, an upper blowout port is formed in the ceiling wall of the cooking chamber, and a side blowout port is formed in one of the inner side walls forming the four sides of the cooking chamber. A suction port is formed in one of the inner side walls other than the inner side wall in which the side blowout port is formed. The upper blowout port is so arranged that the air stream that blows out therefrom does not deflect downward the air stream that blows from the side blowout port to the foods. With this construction, the hot air stream from the upper blowout port blows out chiefly toward elsewhere than where the air stream that flows from the side blowout port to the foods is flowing, and thus the stream of the hot air stream from the side blowout port is not hindered. In this way, the hot air stream from the upper blowout port does not deflect downward the hot air stream from the side blowout port. As a result, the hot air stream from the side blowout port flows along the designed route and reaches the foods, transmitting a required amount of heat to a required portion of the foods. Thus, the hot air stream from the side blowout port can play its expected role satisfactorily, contributing to enhanced quality of the cooked target. This effect is striking particularly in cooking employing a hot-air-impingement method whereby a high-speed hot air stream is blown down from above.

According to the present invention, a cooking oven is constructed as follows. The cooking oven has a blowout port and a suction port for passage of a hot air stream formed inside a cooking chamber to form a circulating air stream of the hot air stream so that foods are cooked with heat as a result of a turntable on which the foods are placed being rotated in the circulating air stream. In this cooking oven, an upper blowout port is formed in the ceiling wall of the cooking chamber, and a side blowout port is formed in one of the inner side walls forming the four sides of the cooking chamber. A suction port is formed in one of the inner side walls adjacent to the inner side wall in which the side blowout port is formed. The hot air stream from the upper blowout port and the hot air stream from the side blowout port are simultaneously blown onto the foods, and the air stream that blows from the side blowout port to the suction port flows by passing through a quarter-circle region of the turntable. With this construction, the foods receive the hot air stream from the upper blowout port and the hot air stream from the side blowout port simultaneously, and is thus efficiently heated. Moreover, as a result of the hot air stream from the side blowout port flowing by passing through a quarter-circle region of the turntable, the amount of hot air stream that is blown onto the portion of the foods located at the center of rotation of the turntable is reduced, reducing the unevenness of heating between this and the other portion of the foods. This helps alleviate uneven cooking, more specifically, uneven roasting.

According to the present invention, the cooking oven constructed as described above is constructed as follows. The side blowout port, the center of the turntable, and the suction port are so arranged that the line connecting the side blowout port to the center of the turntable is approximately perpendicular to the line connecting the center of the turntable to the suction port. This makes it possible to produce the air stream that flows from the side blowout port to the suction port by passing through a quarter-circle region of the turntable. With this construction, simply by appropriately arranging the side blowout port, the center of the turntable, and the suction port, it is possible to make the hot air stream flow as desired. This construction is easy to realize.

According to the present invention, the cooking oven constructed as described above is constructed as follows. The upper blowout port is so arranged that the air stream that blows out therefrom does not deflect downward the air stream that blows from the side blowout port to the foods. With this construction, the hot air stream from the upper blowout port blows out chiefly toward elsewhere than where the air stream that flows from the side blowout port to the foods is flowing, and thus the stream of the hot air stream from the side blowout port is not hindered. In this way, the hot air stream from the upper blowout port does not deflect downward the hot air stream from the side blowout port. As a result, the hot air stream from the upper blowout port flows along the designed route and reaches the foods, transmitting a predetermined amount of heat to a predetermined portion of the foods. Thus, the hot air stream from the side blowout port can play its expected role satisfactorily, contributing to enhanced quality of the cooked target. This effect is striking particularly in cooking employing a hot-air-impingement method whereby a high-speed hot air stream is blown down from above.

According to the present invention, the cooking oven constructed as described above is constructed as follows. The openness of the upper blowout port is smaller in a portion thereof from which the air stream blows out toward the air stream that blows from the side blowout port to the foods blows out than the other portion thereof. With this construction, by adjusting the openness of the upper blowout port, it is possible to achieve the effect of preventing the air stream that blows from the side blowout port to the foods from being deflected downward. This construction is easy to realize.

According to the present invention, the cooking oven constructed as described above is constructed as follows. The upper blowout port consists of a plurality of perforations. The distribution of these perforations of the upper blowout port is made sparser in a portion thereof from which the air stream blows out toward the air stream that blows from the side blowout port to the foods than in the other portion thereof, and this produces the aforementioned difference in the openness of the upper blowout port. With this construction, even if the perforations have a uniform diameter, by adjusting their distribution, it is possible to produce a difference in openness, and thereby to achieve the effect of preventing the air stream that flows from the side blowout port to the foods from being deflected downward. This construction is easy to produce.

According to the present invention, the cooking oven constructed as described above is constructed as follows. A heater is arranged in a ceiling-wall portion of the cooking chamber. The amount of heat generated by the portion of the heater located where the openness of the upper blowout port is smaller is smaller than the portion of the heater located where the openness of the upper blowout port is greater. With this construction, a smaller amount of heat is generated where the openness is smaller. This prevents unnecessary stagnation of hot air. On the other hand, the heat generated by the heater concentrates where the openness of the blowout port is greater. This ensures efficient heating of air.

According to the present invention, the cooking oven constructed as described above is constructed as follows. The heater is a sheath heater, and the portion of the heater that generates a smaller amount of heat is a non-heat-generating portion of the sheath heater. With this construction, the portion of the heater that generates a smaller amount of heat can be formed with the non-heat-generating portion of the sheath heater. This helps simplify the shape of the heater, and thus helps reduce the cost required for the heater.

According to the present invention, the cooking oven constructed as described above is constructed as follows. At least part of the heater for heating the air that blows out from the upper blowout port is arranged on the upstream side of the region where the upper blowout port is arranged. With this construction, it is possible to make uniform the temperature of the hot air stream that blows out from different parts of the upper blowout port. This helps alleviate uneven heating of the foods.

According to the present invention, a cooking oven is constructed as follows. The cooking oven has a blowout port and a suction port for passage of a hot air stream formed inside a cooking chamber so as to be capable of forming a circulating air stream of the hot air stream and is capable of discharging a microwave into the cooking chamber so that foods are cooked with heat by the effect of the hot air stream or the microwave alone or by the combined effect of the hot air stream and the microwave. In this cooking oven, an upper blowout port is formed in the ceiling wall of the cooking chamber, a side blowout port for blowing out the hot air stream is formed in one of the inner side walls forming the four sides of the cooking chamber, and a suction port for sucking in the hot air stream is formed in one of the inner side walls other than the side inner wall in which the side blowout port is formed. The upper blowout port is so arranged that the air stream that blows out therefrom does not deflect downward the air stream that flows from the side blowout port to the foods. A wave feed port for discharging the microwave into the cooking chamber is formed in one of the inner side walls other than the inner side wall in which the side blowout port is formed. The wave feed port for discharging the microwave into the cooking chamber is so arranged as not to directly face the side blowout port. With this construction, the hot air stream from the upper blowout port does not deflect downward the hot air stream from the side blowout port, and thus the hot air stream from the side blowout port flows along the designed route and reaches the foods, transmitting a required amount of heat to a required portion of the foods. Thus, the hot air stream from the side blowout port can play its expected role satisfactorily, contributing to enhanced quality of the cooked target. Moreover, it is possible to prevent pollutants, such as oil dripping from the foods and food fragments, from settling on the wave feed port for the microwave by being carried by the hot air stream blowing out from the side blowout port. This helps avoid accumulation of such sprinkled pollutants, which may start fire or invite electrical discharge by the microwave.

According to the present invention, the cooking oven constructed as described above is constructed as follows. The wave feed port is arranged in the inner side wall in which the side blowout port is formed. With this construction, the hot air stream that blows out from the side blowout port does not hit the wave feed port, which is formed in the same wall surface as the side blowout port, and thus does not sprinkle the wave feed port with pollutants. This helps avoid accumulation of sprinkled pollutants, which may start fire or invite electrical discharge by the microwave.

According to the present invention, the cooking oven constructed as described above is constructed as follows. The wave feed port is arranged in one of the inner side walls other than the inner side wall in which the side blowout port is formed and in such a way that the lower end of the wave feed port is located above the height-direction center of the side blowout port. With this construction, the side blowout port and the wave feed port are deviated from each other in the vertical direction so as not to directly face each other. Thus, the hot air stream that blows out from the side blowout port is less likely to sprinkle the wave feed port with pollutants. This helps avoid accumulation of sprinkled pollutants, which may start fire or invite electrical discharge by the microwave.

According to the present invention, the cooking oven constructed as described above is constructed as follows. The wave feed port is arranged in the inner side wall facing the inner side wall in which the side blowout port is formed and in such a way that the wave feed port does not directly face half or more of the horizontal width of the side blowout port. With this construction, the side blowout port and the wave feed port are deviated from each other in the horizontal direction so as not to directly face each other. Thus, the hot air stream that blows out from the side blowout port is less likely to sprinkle the wave feed port with pollutants. This helps avoid accumulation of sprinkled pollutants, which may start fire or invite electrical discharge by the microwave. According to the present invention, a cooking oven is constructed as follows. The cooking oven has a blowout port and a suction port for passage of a hot air stream formed inside a cooking chamber to form a circulation of hot air stream so that foods are cooked with heat by the circulating air stream. In this cooking oven, an upper blowout port formed by a plurality of perforations is formed in the ceiling wall of the cooking chamber, and a side blowout port formed by a plurality of perforations is formed in one of the inner side walls forming the four sides of the cooking chamber. The perforations forming the upper blowout port are each provided with a cylindrical portion that is so formed as to project outward from the heating chamber so that those perforations of the upper blowout port are given an axial length equal to or greater than the thickness of the member forming the ceiling wall. On the other hand, the perforations forming the side blowout port are each so formed as to have an axial length equal to or smaller than the thickness of the member forming the inner side wall. With this construction, the upper blowout port functions as a nozzle. Thus, the hot air stream that blows out from the upper blowout port forms a stream in the shape of a beam and collides with the foods without diminishing its flow speed. This helps apply powerful hot-air impingement on the foods. On the other hand, the hot air stream that blows out from the side blowout port starts to spread as soon as it exits from the side blowout port. This hot air stream, when it hits the foods, encloses widely and softly the side and lower faces of the foods while applying thereto weakened impingement. This makes it possible to more effectively exploit the characteristics of different cooking methods, as both in cooking employing a hot-air-impingement method whereby a high-speed hot air stream is blown down from above and in preparation of sponge cake in which a higher weight is given to a hot air stream that blows out from the side blowout port. Moreover, since the axial-direction length of the perforations is secured by the cylindrical portion that projects outward from the heating chamber, while the upper blowout port is given a necessary axial length, the lower surface of the ceiling wall is given a flat shape without any projection. This makes cleaning of the cooking chamber easy, and also helps prevent the user's fingers from being injured by being caught by such projections.

BEST MODE FOR CARRYING OUT THE INVENTION

Figure 15:
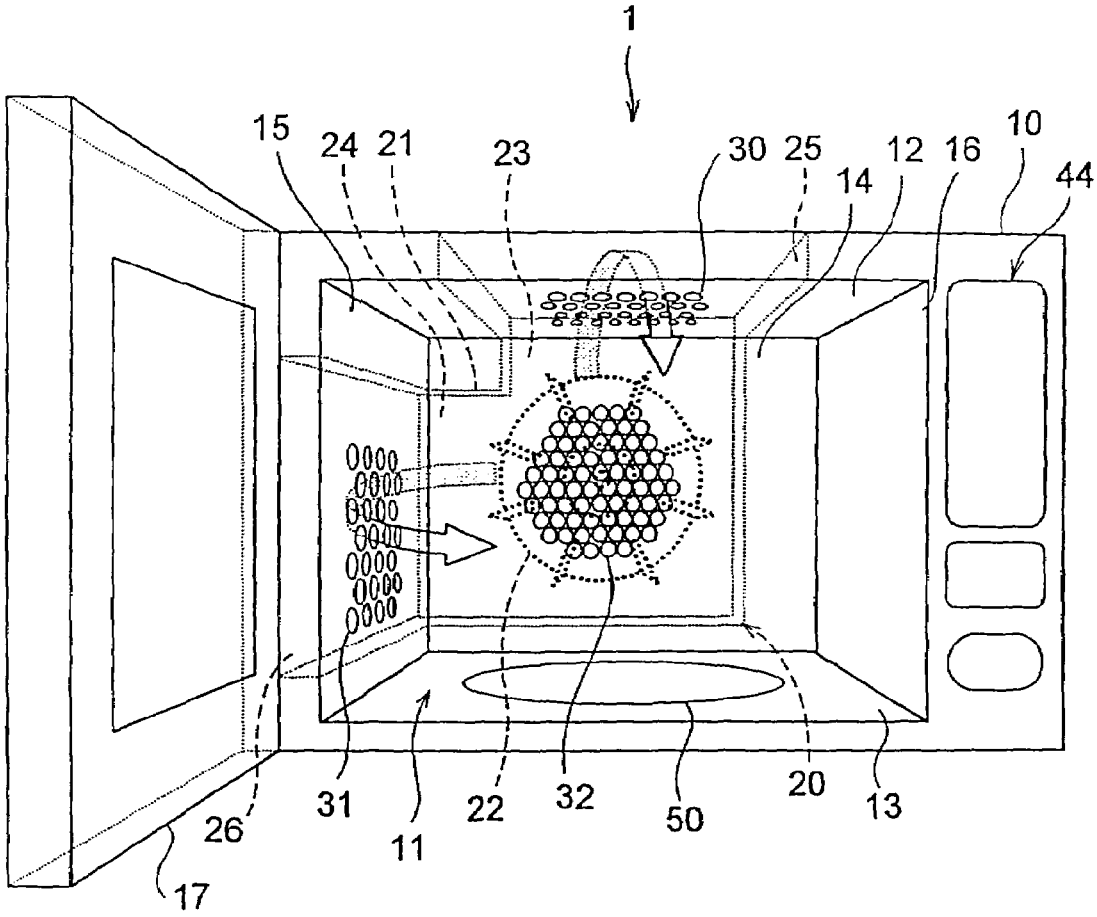
FIG. 15 is a front view of a cooking oven that serves as the basis of the present invention, as illustrated in a perspective view.
Figure 16:
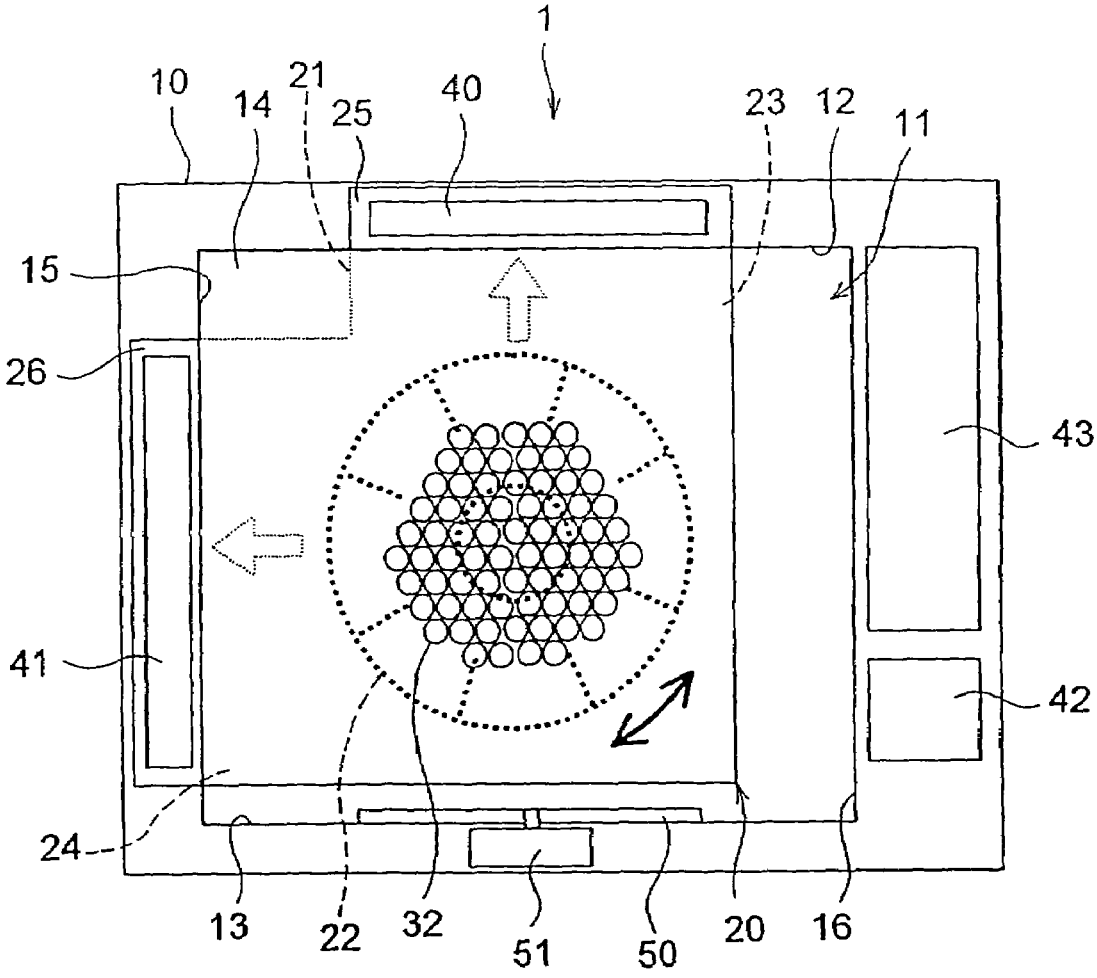
FIG. 16 is a vertical sectional view of the cooking oven shown in FIG. 15.
Figure 17:
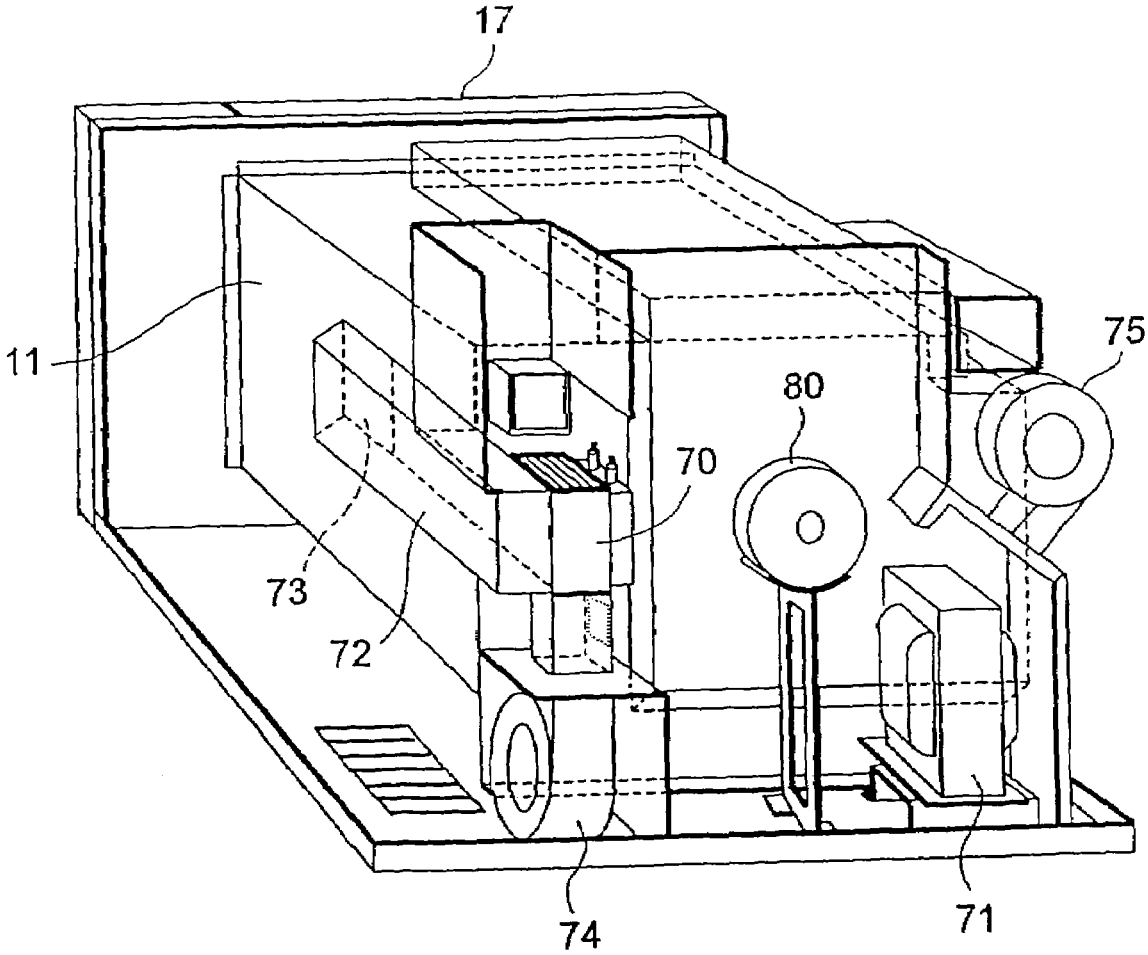
FIG. 17 is a perspective view showing the construction of the microwave heating device used in the cooking oven shown in FIG. 15.
Figure 18:
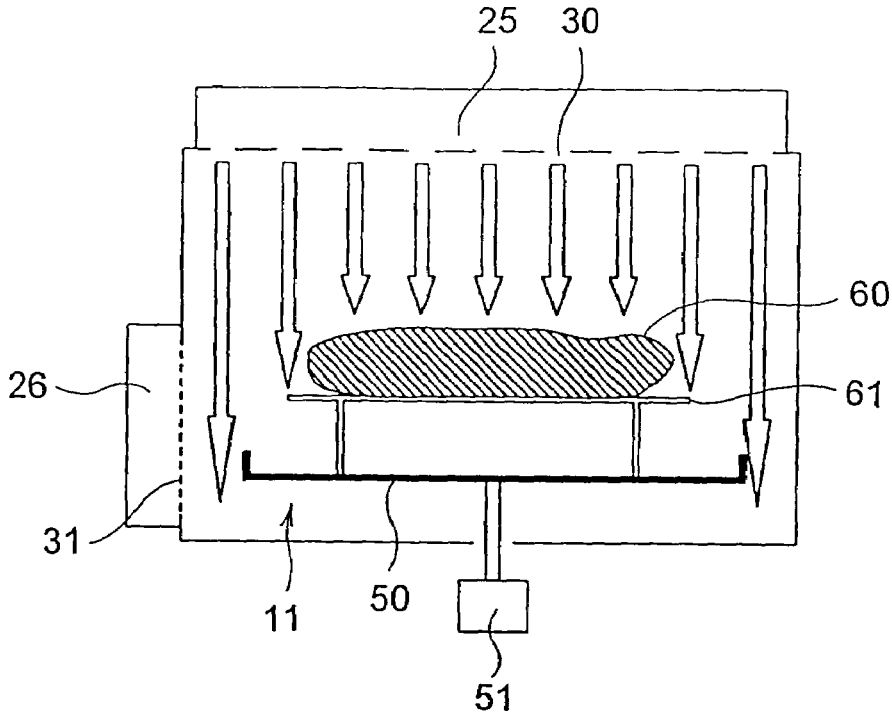
FIG. 18 is a first schematic vertical sectional view illustrating how hot air flows in the cooking oven shown in FIG. 15.
Figure 19:
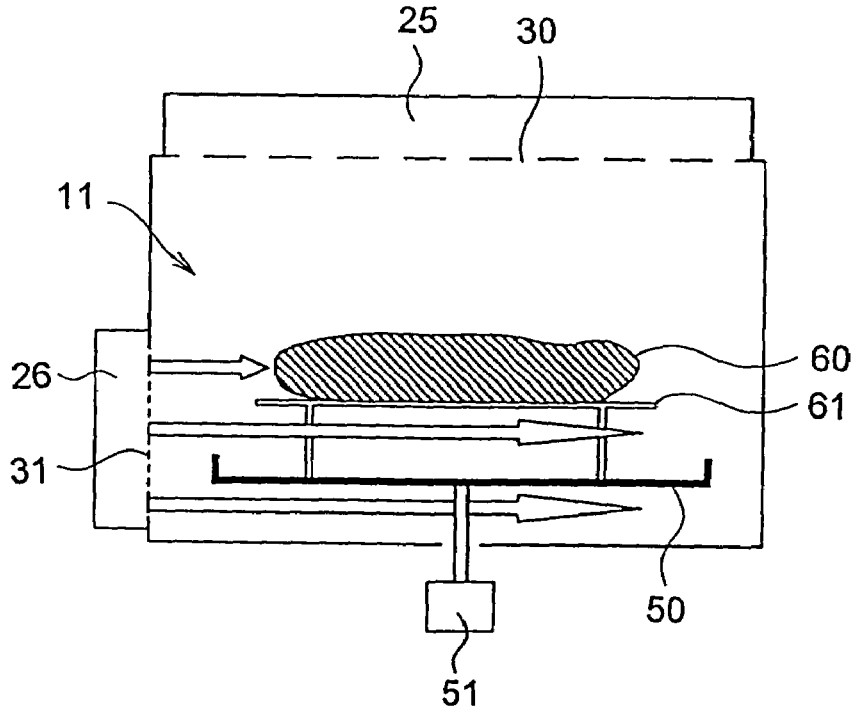
FIG. 19 is a second schematic vertical sectional view illustrating how hot air flows in the cooking oven shown in FIG. 15.
Figure 20:
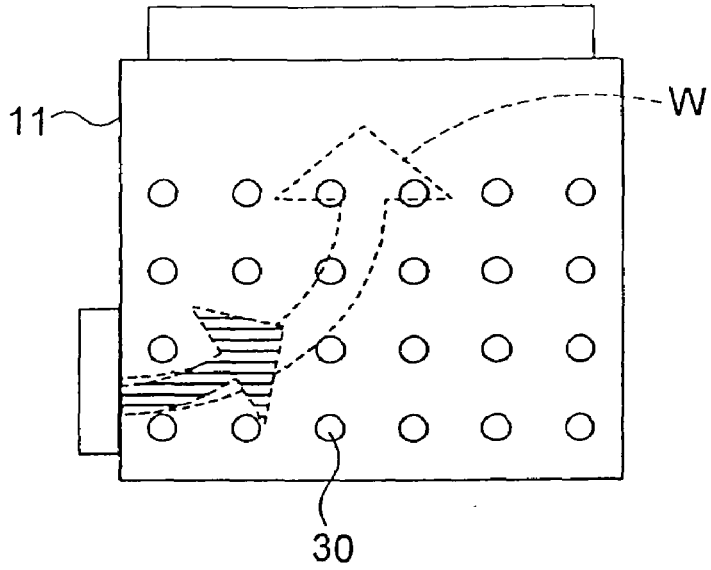
FIG. 20 is a schematic horizontal sectional view illustrating the problem encountered in the cooking oven shown in FIG. 15.
Figure 21:
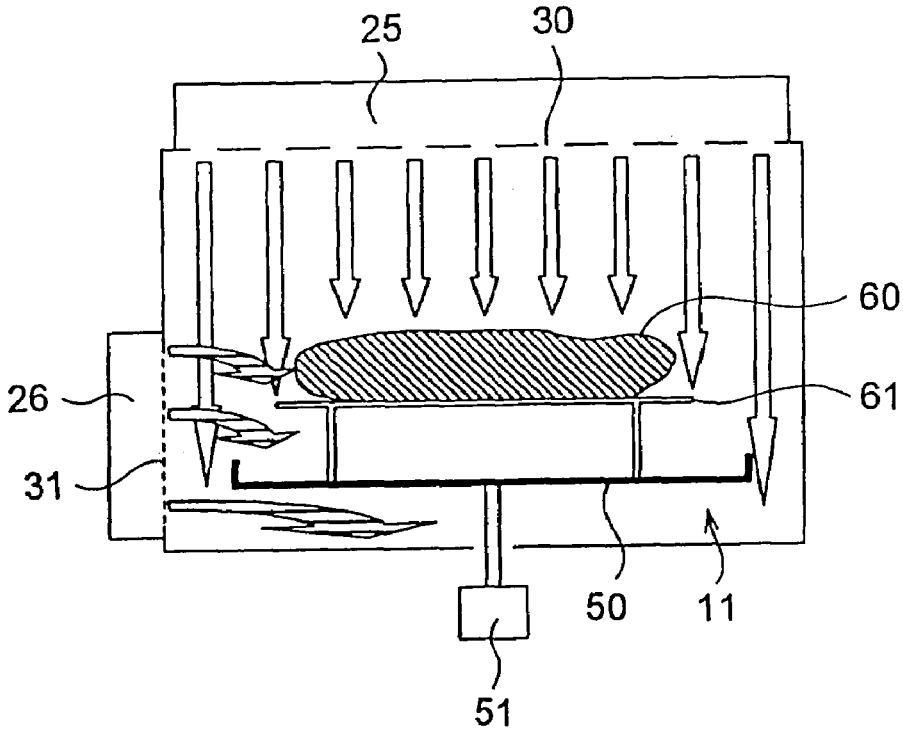
FIG. 21 is a schematic vertical sectional view illustrating the problem encountered in the cooking oven shown in FIG. 15.

Hereinafter, a first embodiment of a cooking oven according to the invention will be described with reference to FIG. 1. The construction that serves as the basis of the cooking oven 1 of the first embodiment is the same as that for the cooking oven 1 shown in the figures starting with FIG. 15, and therefore, here, only such components as are relevant to the invention are illustrated. Of the components of the cooking oven 1 of the first embodiment, those which are common to the cooking oven 1 shown in the figures starting with FIG. 15 are identified with the same reference numbers as used earlier for them, and their explanations will not be repeated. The same principle is applied also to the second and following embodiments; that is, such components as have already been described are identified with the same reference numbers as used earlier for them, and their explanations will not be repeated unless necessary.

In the cooking oven 1 of the first embodiment, the arrangement is such that the air stream that blows out from the upper blowout port 30 does not deflect downward the air stream that blows from the side blowout port 31 to the foods 60. It should be understood that the expression "not deflect" used here does not solely mean "no deflection at all" but encompasses "a small degree of deflection."

To prevent the air stream that blows from the side blowout port 31 to the foods 60 from being deflected downward, the following construction is adopted. The openness (the proportion of the area of the open portion) of the upper blowout port 30 formed in the ceiling wall 12 is made smaller in the portion thereof from which the air stream blows out toward the air stream that blows from the side blowout port 31 to the foods 60 than in the other portion thereof.

The difference in the openness of the upper blowout port 30 is produced by varying the distribution of the perforations that form the upper blowout port 30. Specifically, the distribution of the perforations of the upper blowout port is made sparser, and thereby the openness of the upper blowout port is made smaller, in the portion thereof from which the air stream blows out toward the air stream that blows from the side blowout port 31 to the foods 60 than in the other portion thereof.

The perforations of the upper blowout port 30 all have an equal diameter (each 11 mm across). Giving them a uniform diameter in this way makes it easy to produce a die for forming the perforations, and is therefore advantageous from the perspective of production. It should be understood, however, that this does not necessarily exclude constructions in which the perforations are given different diameters.

Figure 1:
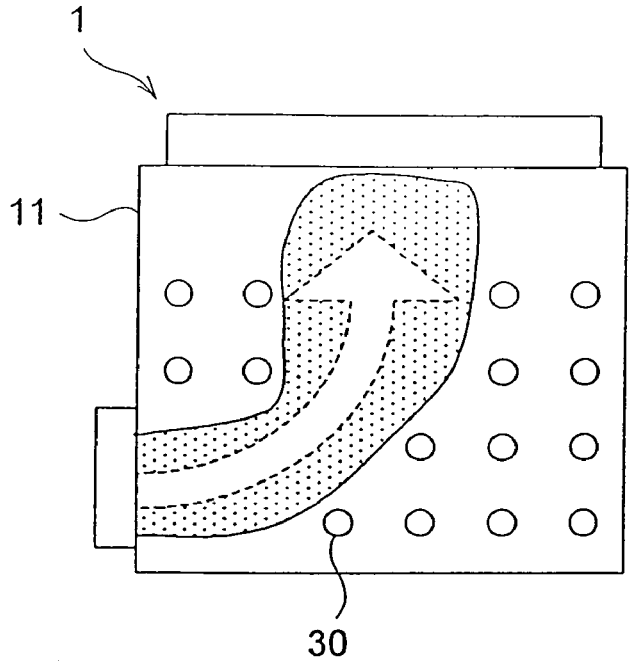
FIG. 1 is a schematic horizontal sectional view showing a first embodiment of a cooking oven according to the invention.

What is shown in FIG. 1 is an example in which "sparseness" is pursued to the limit. Specifically, no perforations at all are formed right above the air stream that flows from the side blowout port 31 to the foods 60. More specifically, consider an air stream that flows through from the side blowout port 31 to the suction port 32 when the foods 60 are absent. In the region located right above such an air stream, "no perforations at all" are formed. Accordingly, the hot air stream that blows out from the side blowout port 31 flows to the foods 60 without being deflected downward by the hot air stream that blows out from the upper blowout port 30. This hot air stream blows through along the bottom face of the foods 60, and thus transmits a sufficient amount of heat to the bottom face of the foods 60.

The effect described above is more striking in cooking employing a hot-air-impingement method whereby a high-speed hot air stream is blown down from the upper blowout port 30. This effect is obtained not only in constructions that include a turntable 50 for rotating the foods 60 but also in constructions that do not include one.

Even in constructions in which not none but some of the perforations of the upper blowout port 30 are located right above the air stream that flows from the side blowout port 31 to the foods 60, it is possible to obtain the effect to a corresponding degree.

Figure 2:
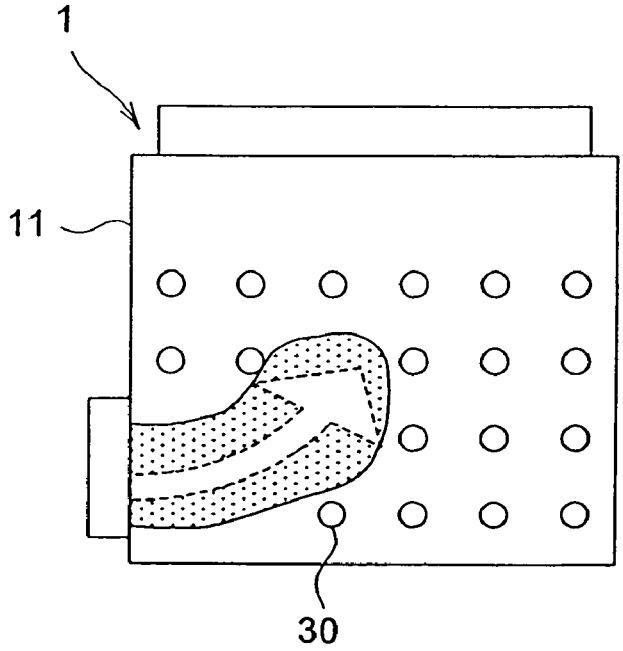
FIG. 2 is a schematic horizontal sectional view showing a second embodiment of a cooking oven according to the invention.

FIG. 2 shows a second embodiment of a cooking oven according to the invention. The cooking oven 1 of the second embodiment is assumed to be provided with a turntable 50.

Also in the cooking oven 1 of the second embodiment, the arrangement is such that the air stream that blows out from the upper blowout port 30 does not deflect downward the air stream that blows from the side blowout port 31 to the foods 60. It should be understood that, as in the first embodiment, the expression "not deflect" used here does not solely mean "no deflection at all" but encompasses "a small degree of deflection."

To prevent the air stream that blows from the side blowout port 31 to the foods 60 from being deflected downward, the following construction is adopted. The openness (the proportion of the area of the open portion) of the upper blowout port 30 formed in the ceiling wall 12 is made smaller in the portion thereof from which the air stream blows out toward the air stream that blows from the side blowout port 31 to the foods 60 than in the other portion thereof.

The difference in the openness of the upper blowout port 30 is produced by varying the distribution of the perforations that form the upper blowout port 30. Specifically, the distribution of the perforations of the upper blowout port is made sparser, and thereby the openness of the upper blowout port is made smaller, in the portion thereof from which the air stream blows out toward the air stream that blows from the side blowout port 31 to the foods 60 than in the other portion thereof.

As in the first embodiment, the perforations of the upper blowout port 30 all have an equal diameter (each 11 mm across). Giving them a uniform diameter in this way makes it easy to produce a die for forming the perforations, and is therefore advantageous from the perspective of production. It should be understood, however, that this does not necessarily exclude constructions in which the perforations are given different diameters.

What is shown in FIG. 2 is an example in which "sparseness" is pursued to the limit. Specifically, no perforations at all are formed where the air stream therefrom (meaning that, if any perforation is formed, the air stream therefrom) will blow out therefrom toward the air stream that flows from the side blowout port 31 to the foods 60. More specifically, consider an air stream that flows through from the side blowout port 31 to the suction port 32 when the foods 60 are absent. In the region through which that air stream passes to reach the center of the turntable 50, "no perforations at all" are formed.

In this construction, the hot air stream that blows out from the side blowout port 31 reaches the foods 60 without being deflected downward by the hot air stream that flows out from the upper blowout port 30. Thus, before this hot air stream reaches the center of the turntable 50, a sufficient amount of heat can be transmitted from the hot air stream to the bottom face of the foods 60. On the other hand, the air stream that flows horizontally through along the bottom face of the foods 60, even when it flows past the center of the turntable 50, continues to flow through while keeping contact with the foods 60 until it flows past it, because the foods 60 blocks the air stream from the upper blowout port 30. Thus, a sufficient amount of heat can be transmitted to the bottom face of the cooking target 60.

The air stream that flows horizontally through along the top face of the foods 60, when it flows past the center of the turntable 50, is deflected downward by the air stream from the upper blowout port 30. This permits the hot air stream from the side blowout port 31 to hit the top face of the foods 60 well, and thus, rather than causing a problem, helps prompt heating.

Figure 3:
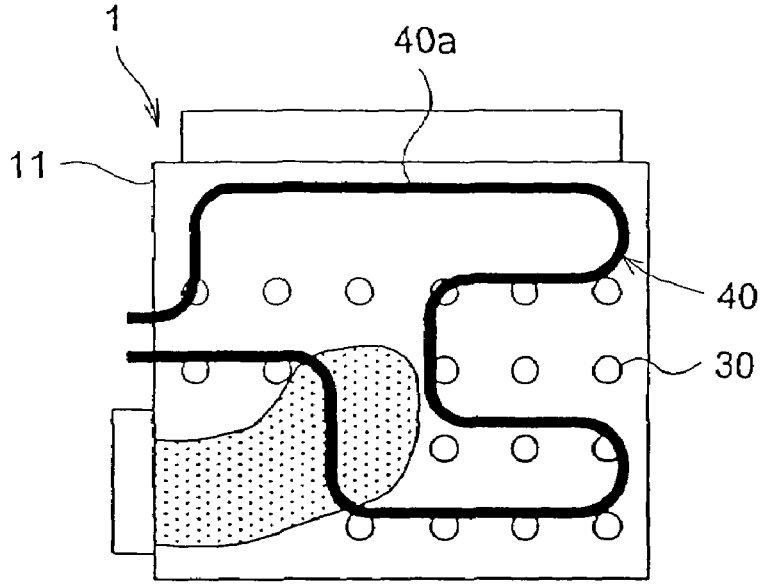
FIG. 3 is a schematic horizontal sectional view showing a third embodiment of a cooking oven according to the invention.

FIG. 3 shows a third embodiment of a cooking oven according to the invention. The cooking oven 1 of the third embodiment is characterized by the construction of the upper heater 40 arranged in the ceiling wall 12 of the cooking chamber 11. Specifically, in this embodiment, the upper heater 40 is so constructed as to generate a smaller amount of heat in the portion thereof located where the openness of the upper blowout port 30 is smaller than in the portion thereof located where the openness of the upper blowout port 30 is greater. As in the first and second embodiments, the difference in openness is produced by appropriately distributing the perforations forming the upper blowout port 30.

Specifically, as in the second embodiment, the distribution of the perforations of the upper blowout port 30 is made sparser (including "no perforations at all") in the portion thereof from which the air stream blows out toward the air stream that flows from the side blowout port 31 to the foods 60. The upper heater 40 is realized with a linear heater such as a Nichrome wire or a sheath heater. This linear heater is so laid as to avoid where the distribution of the perforations is sparser.

In this construction, the upper heater 40 generates a smaller amount of heat where the openness of the upper blowout port 30 is smaller. This helps avoid unnecessarily heating the air present in areas where no air stream passes. On the other hand, the heat generated by the upper heater 40 concentrates where the openness of the upper blowout port 30 is greater. This ensures efficient heating of air.

Practical methods for varying the amount of heat generated by the upper heater 40 from place to place include, in addition to the one described above whereby "a linear heater is laid along an ingeniously designed route" as described above, the following method.

With a sheath heater, the amount of heat it generates can be varied by varying the number of turns per unit length by which the resistive wire provided inside it is wound. Specifically, winding the resistive wire tightly increases the amount of heat generated, and winding it loosely decreases the amount of heat generated. Where the resistive wire is left rectilinear, it generates a minimum amount of heat. The same is true with a bare Nichrome wire.

Incidentally, a sheath heater typically generates a smaller amount of heat in its terminal portions (where it is connected to wiring leads) and a larger amount of heat in its central portion.

Another way to reduce the mount of heat generated is to fit a conducting member to a portion of the resistive wire of a sheath heater or to a portion of a coil formed of a bare Nichrome wire so as to reduce the resistance of that portion.

In the cooking oven 1 of the third embodiment, part 40*a* of the upper heater 40 is arranged on the upstream side, with respect to the stream of the hot air stream, of the region where the upper blowout port 30 is arranged. With this construction, the air heated by that part 40*a* of the upper heater 40 blows out from every perforation of the upper blowout port 30. This helps make uniform the temperature of the hot air that blows out from every perforation of the upper blowout port 30.

Figure 4:
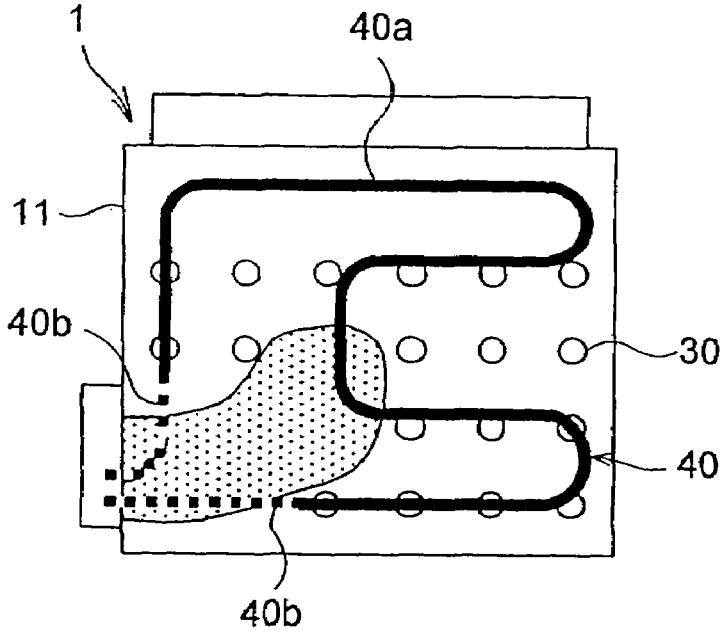
FIG. 4 is a schematic horizontal sectional view showing a fourth embodiment of a cooking oven according to the invention.

FIG. 4 shows a fourth embodiment of a cooking oven according to the invention. Also in the cooking oven 1 of the fourth embodiment, the upper heater 40 is so constructed as to generate a smaller amount of heat in the portion thereof located where the openness of the upper blowout port 30 is smaller than in the portion thereof located where the openness of the upper blowout port 30 is greater. This is achieved as follows. Here, as in the third embodiment, the openness of the upper blowout port 30 is varied by varying the distribution of the perforations of the upper blowout port 30.

The upper heater 40 is realized with a sheath heater. Any sheath heater has a non-heat-generating portion, and the non-heat-generating portion 40*a* of the upper heater 40 is arranged where the distribution of the perforations of the upper blowout port 30 is sparse (including "no perforations at all").

In this construction, the upper heater 40 does not generate heat where the openness of the upper blowout port 30 is smaller, and thus does not heat the air present in areas where no air stream passes. The heat generated by the upper heater 40 concentrates where the openness of the upper blowout port 30 is greater. This ensures efficient heating of air.

Also in the cooking oven 1 of the fourth embodiment, part 40*a* of the upper heater 40 is arranged on the upstream side, with respect to the stream of the hot air stream, of the region where the upper blowout port 30 is arranged. Thus, the air heated by that part 40*a* of the upper heater 40 blows out from every perforation of the upper blowout port 30. This helps make uniform the temperature of the hot air that blows out from every perforation of the upper blowout port 30.

Figure 5:
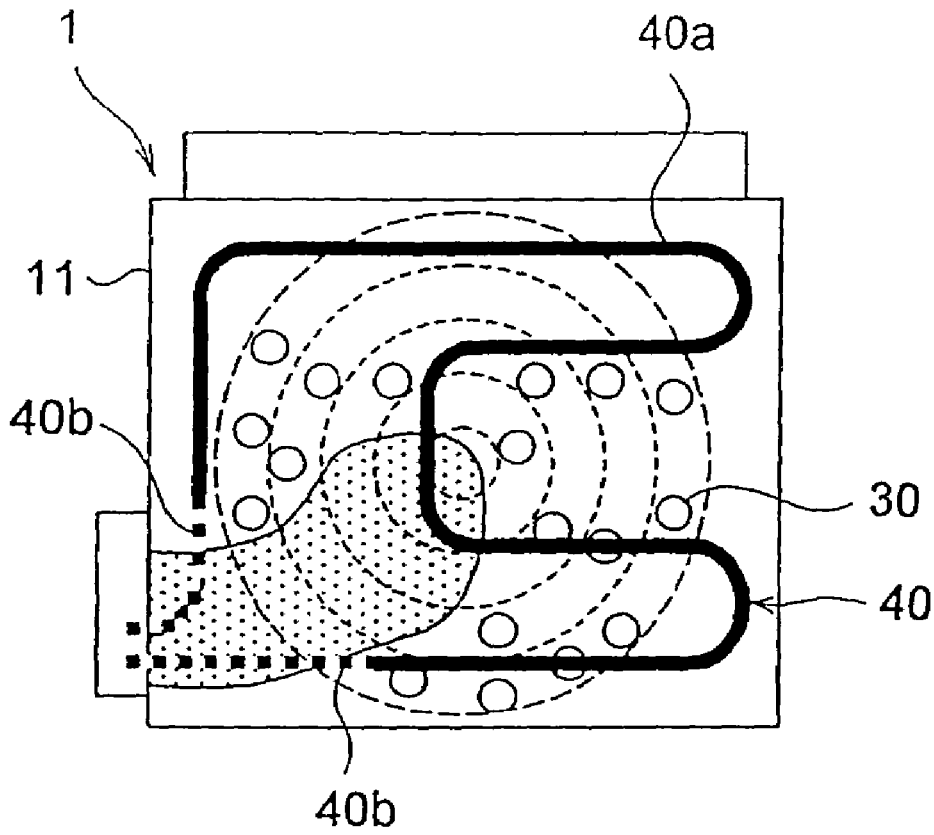
FIG. 5 is a schematic horizontal sectional view showing a fifth embodiment of a cooking oven according to the invention.

FIG. 5 shows a fifth embodiment of a cooking oven according to the invention. The cooking oven 1 of the fifth embodiment is assumed to be provided with a turntable 50, and in addition is characterized in that the upper blowout port 30 is so arranged that no part thereof lies off the turntable 50.

Specifically, in a portion of the ceiling wall 12 located right above the turntable 50, the perforations of the upper blowout port 30 are so distributed as not to be located outside the edge of the turntable 50. To make the openness of the upper blowout port 30 smaller in the portion thereof closer to the center of the turntable 50 and greater in the portion thereof closer to the edge of the turntable 50, the distribution of the perforations of the upper blowout port 30 is made sparser in the portion thereof closer to the center of the turntable 50 than in the portion thereof closer to the edge of the turntable 50.

In FIG. 5, regions concentric with the turntable 50 are illustrated above the turntable 50. These concentric regions are illustrated merely for the purpose of explanation, and no components having such shapes are provided in reality. Comparing the numbers of perforations located in those concentric ring-shaped regions will make clear that outer regions include greater numbers of perforations than are expected from the ratios of their circumferential lengths to those of inner regions. In this way, the distribution of the perforations of the upper blowout port 30 is made "sparser in the portion thereof closer to the center of the turntable 50 and denser in the portion thereof closer to the edge of the turntable 50."

The reason that "the openness of the upper blowout port 30 is made smaller in the portion closer to center of the turntable 50 and greater in the portion thereof closer to the edge of the turntable 50" is as follows. The portion of the foods 60 located at the center of the turntable 50 rotates with low linear velocity, and is thus liberally exposed to the hot air stream. On the other hand, the portion of the foods 60 located at the edge of the turntable 50 rotates with the same angular velocity but with higher linear velocity, and thus quickly passes by the position where the hot air stream blows onto it. To compensate for this, the openness of the upper blowout port 30 is made greater in the portion closer to the edge of the turntable 50 than in the portion thereof closer to the center of the turntable 50. This permits every part of the top face of the foods 60 to be exposed uniformly to the hot air stream.

In the fifth embodiment, the construction is also such that "the openness of the upper blowout port 30 is made smaller in the portion thereof from which the air stream blows out toward the air stream that flows from the side blowout port 31 to the foods 60." In addition, the construction is also such that "the upper heater 40 generates a smaller amount heat in the portion thereof located where the openness of the upper blowout port 30 is smaller than in the portion thereof located where the openness of the upper blowout port 30 is greater." Furthermore, the construction is also such that "part 40*a* of the upper heater 40 for heating the air that blows out from the upper blowout port 30 is arranged on the upstream side, with respect to the stream of the hot air stream, of the region where the upper blowout port 30 is arranged."

Figure 6:
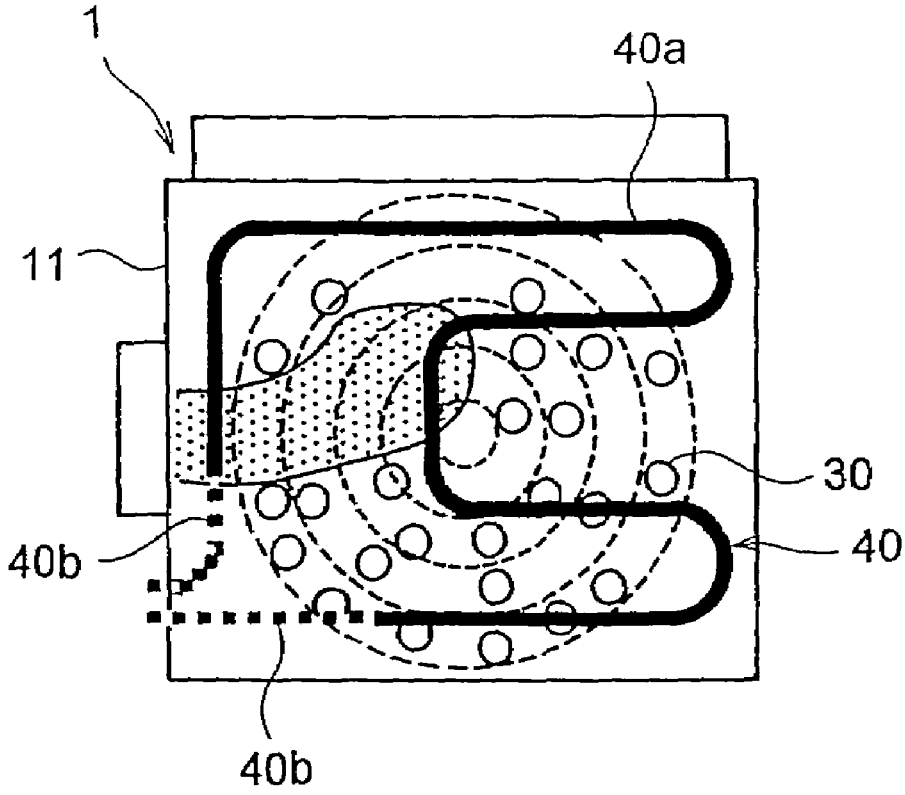
FIG. 6 is a schematic horizontal sectional view showing a sixth embodiment of a cooking oven according to the invention.

FIG. 6 shows a sixth embodiment of a cooking oven according to the invention. The cooking oven 1 of the sixth embodiment is assumed to be provided with a turntable 50, and in addition is characterized in that the air stream that flows from the side blowout port 31 to the suction port 32 flows by passing through a quarter-circle region of the turntable 50. Here, a "quarter-circle region" denotes one of the four fan-shaped regions of a circle that are formed by cutting the circle with two arbitrary but mutually perpendicular diametrical lines. This, however, is merely a conceptual definition, and thus is not meant to strictly require, for example, that "the fan-shaped region have its pivot just at the center of the turntable and have a center angle of 90°."

Such a construction is realized as follows. The side blowout port 31, the center of the turntable 50, and the suction port 32 are arranged in such a way that the line connecting the side blowout port 31 to the center of the turntable 50 is approximately perpendicular to the line connecting the center of the turntable 50 to the suction port 32.

In this construction, when a hot air stream is blown out from the side blowout port 31 while air is sucked into the suction port 32, the hot air stream flows as if to sweep a quarter-circle region of the turntable 50, and thus heats the portion of the foods 60 located in that region. The hot air stream also hits the portion of the foods 60 located at the center of the turntable 50, but this part of the hot air stream is deviated from its main stream and thus contains only a small amount of hot air stream. Accordingly, although this portion of the foods 60 is one that receives the hot air stream all the time, it is heated less differently from the other portion thereof.

In the sixth embodiment, as in the fifth embodiment, the construction is also such that "the openness of the upper blowout port 30 is made smaller in the portion thereof from which the air stream blows out toward the air stream that flows from the side blowout port 31 to the foods 60." The construction is also such that "the upper heater 40 generates a smaller amount heat in the portion thereof located where the openness of the upper blowout port 30 is smaller than in the portion thereof located where the openness of the upper blowout port 30 is greater." The construction is also such that "part 40*a* of the upper heater 40 for heating the air that blows out from the upper blowout port 30 is arranged on the upstream side, with respect to the stream of the hot air stream, of the region where the upper blowout port 30 is arranged." The construction is also such that "no part of the upper blowout port 30 is located outside the edge of the turntable 50." The construction is also such that "the openness of the upper blowout port 30 is smaller in the portion thereof closer to the center of the turntable 50 and greater in the portion thereof closer to the edge of the turntable 50." The construction is also such that "the distribution of the perforations constituting the turntable 50 is sparser in the portion thereof closer to the center of the turntable 50 and denser in the portion thereof closer to the edge of the turntable 50."

The fifth and sixth embodiments compare as follows. In the fifth embodiment, the side blowout port 31 is arranged in a front portion of the cooking chamber 11 (a portion thereof closer to the door 17). As a result, the path along which the hot air stream flows from the side blowout port 31 to near the center of the turntable 50 is longer than in the sixth embodiment. By contrast, in the sixth embodiment, the side blowout port 31 is so formed as to be located at the minimum distance from the center of the turntable 50. Thus, in the sixth embodiment, the area in which the perforations of the upper blowout port 30 cannot be formed is narrower than in the fifth embodiment. This accordingly increases the flexibility of the arrangement of the perforations of the upper blowout port 30.

Figure 7:
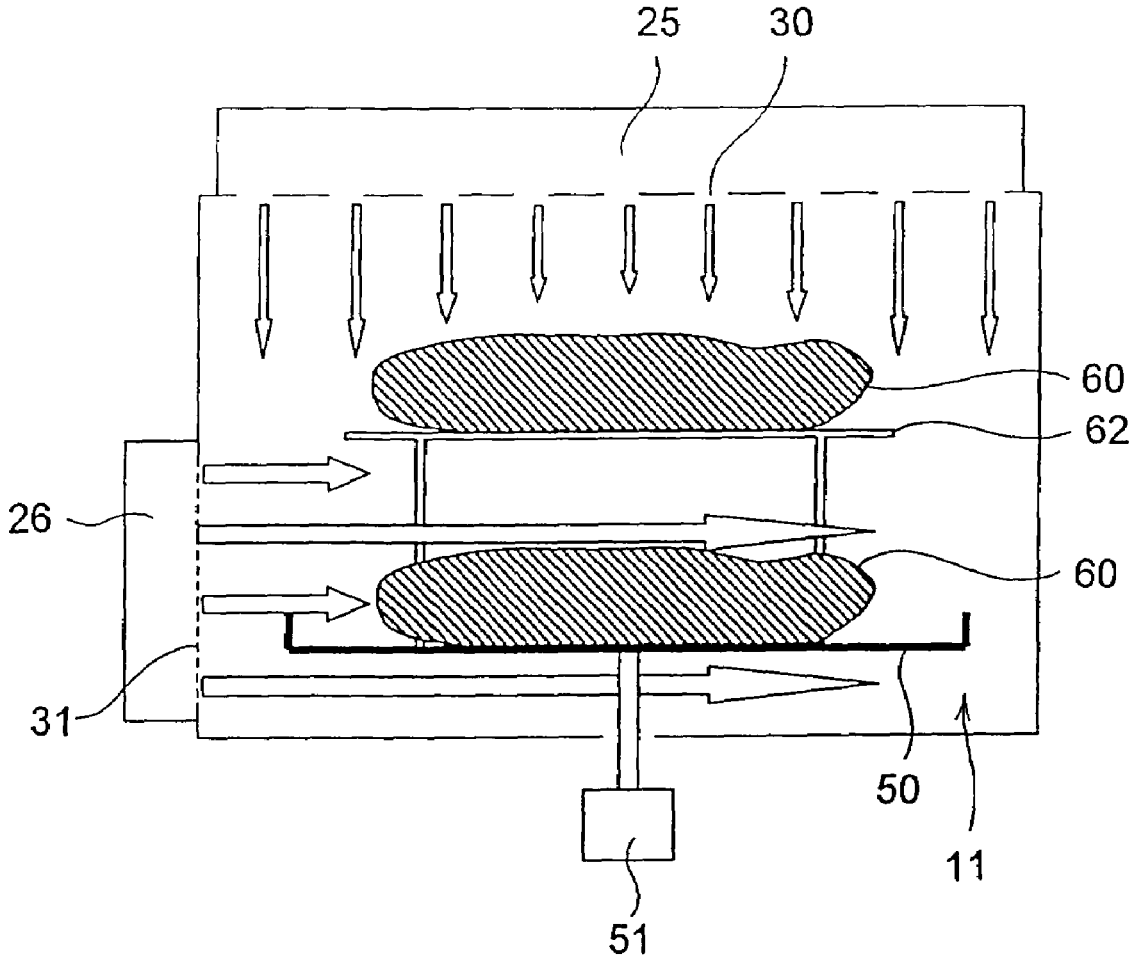
FIG. 7 is a schematic vertical sectional view of the cooking oven.

FIG. 7 is a diagram illustrating the position of the side blowout port 31 in the vertical direction. The side blowout port 31 is so formed as to extend from a height lower than half the height of the cooking chamber 11 to close to the floor surface of the cooking chamber 11. With this arrangement, when two-stage cooking of cake or the like is performed with a rack placed on the turntable 50, the hot air stream uniformly hits the upper and lower stages. This construction applies to any of the first to sixth embodiments.

Figure 8:
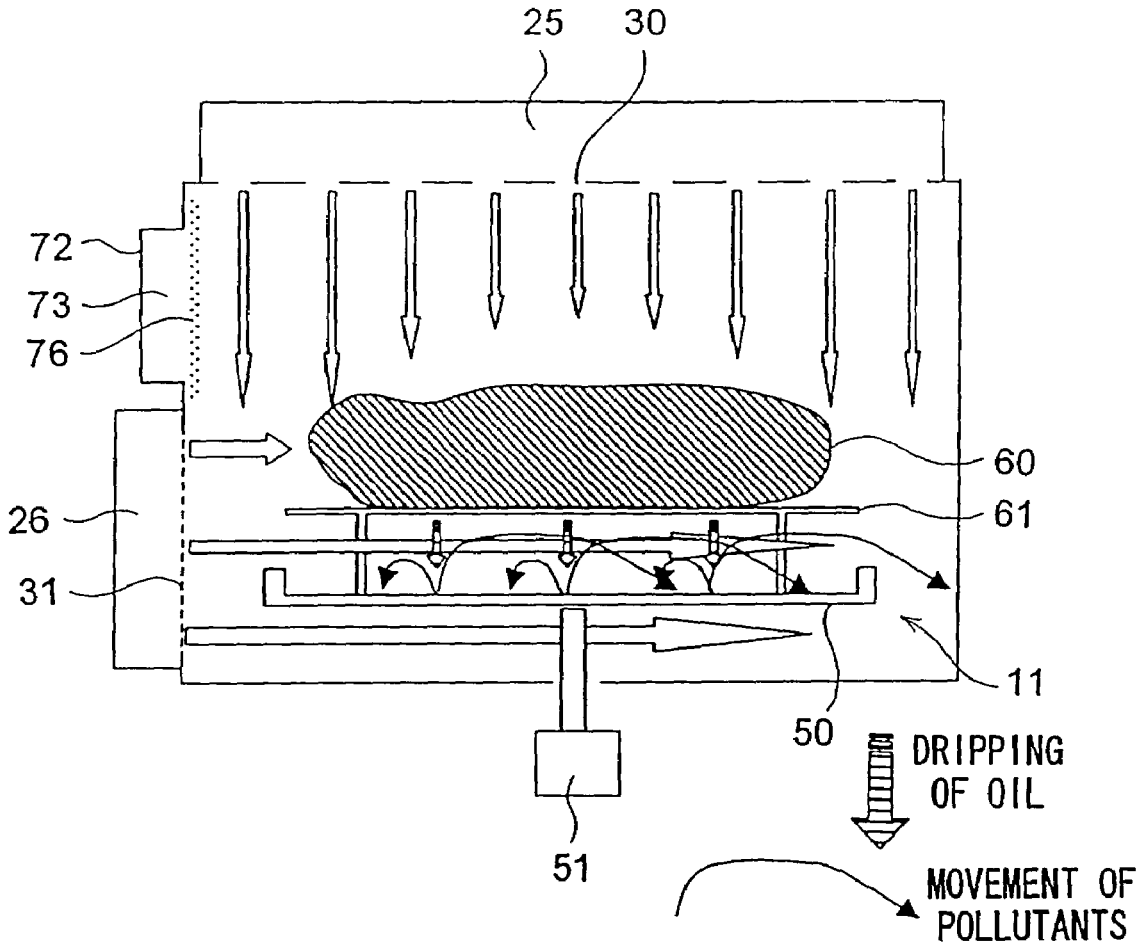
FIG. 8 is a schematic vertical sectional view of a seventh embodiment of a cooking oven according to the invention.

FIG. 8 shows a seventh embodiment of a cooking oven according to the invention. This embodiment is characterized by the position of the wave feed port 73. Specifically, the wave feed port 73 is formed in a position where it does not directly face the side blowout port 31. Here, "to directly face" means "to be located right in front of."

More specifically, the wave feed port 73 is formed in the left inner wall 15, in such a position as to be located above the side blowout port 31. The wave feed port 73 is covered with a cover 76 such as a punched metal sheet or metal mesh in order to prevent entry of the user's fingers or any other foreign object into the waveguide 72.

As cooking is performed, pollutants are produced from the foods 60. In a case such as when roasted chicken or the like is cooked with a grill 61 placed on the turntable 50 as shown in FIG. 8, oil drips from the foods 60. Fine particles of oil fly by being carried by the hot air stream. On the other hand, in a case such as when cake or other food made from flour is baked, the flour itself may fly by being carried by the hot air stream. In addition to these, various food fragments become pollutants.

If the wave feed port 73 is formed in a position in which it directly faces the side blowout port 31, the hot air stream that blows out from the side blowout port 31 sprinkles the wave feed port 73 with pollutants. The sprinkled pollutants settle and accumulate on the cover 76. The accumulated pollutants start fire when conditions permit them to, or cause electric discharge by the microwave at a pointed part of the accumulated pollutants. This surprises the user.

In the seventh embodiment, the wave feed port 73 is formed in the left inner wall 15, i.e., in the same wall where the side blowout port 31 is formed. This prevents the hot air stream from the side blowout port 31 from sprinkling the wave feed port 73 with pollutants. This helps prevent problems such as pollutants starting fire or causing electric discharge. By forming the wave feed port 73 above the side blowout port 31, it is possible to more securely achieve that effect.

Figure 9:
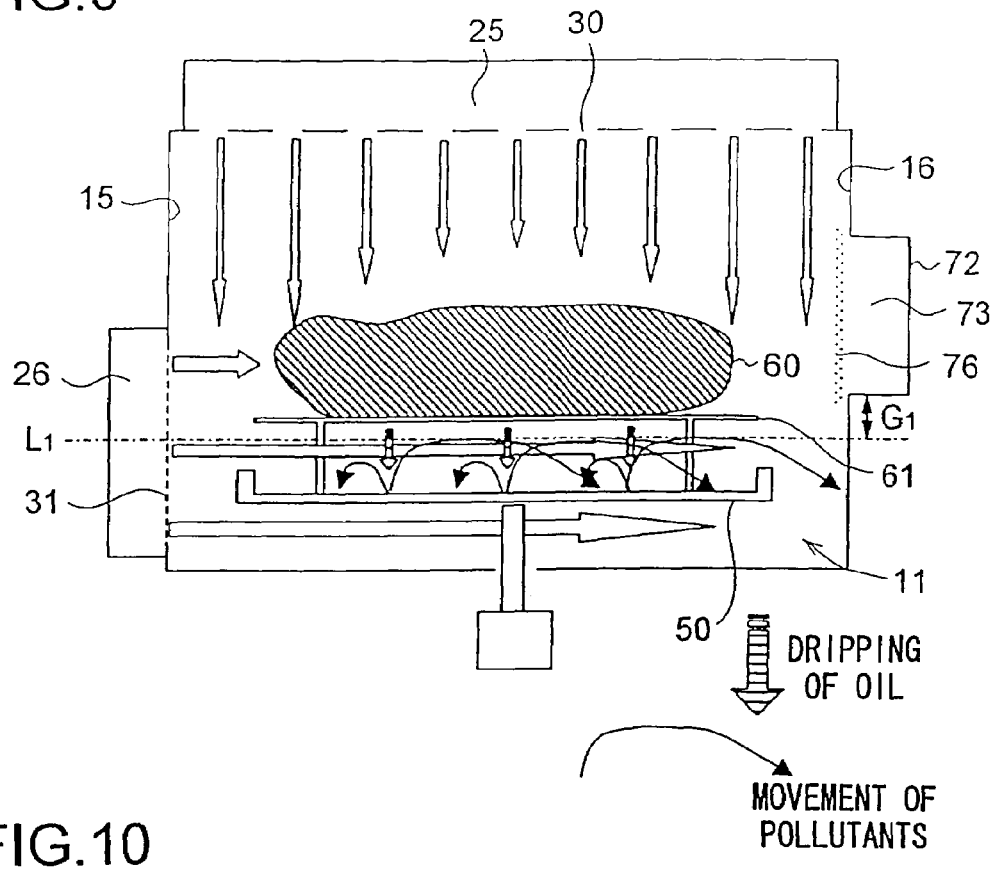
FIG. 9 is a schematic vertical sectional view of an eighth embodiment of a cooking oven according to the invention.

FIG. 9 shows an eighth embodiment of a cooking oven according to the invention. This embodiment also is characterized by the position of the wave feed port 73. The wave feed port 73 is formed in one of the side inner walls other than the one in which the side blowout port 31 is formed, specifically, here, in the right inner wall 16. The lower end of the wave feed port 73 is located above the height-direction center (indicated by line $L_1$) of the side blowout port 31. In the case shown in the figure, the lower end of the wave feed port 73 is located a distance of $G_1$ higher than the height-direction center of the side blowout port 31.

In this way, the side blowout port 31 and the wave feed port 73 are deviated vertically from each other so as not to directly face each other. This reduces the risk of the hot air stream that blows out from the side blowout port 31 sprinkling the wave feed port 73 with pollutants, and thus reduces the risk of pollutants starting fire or causing electric discharge.

Figure 10:
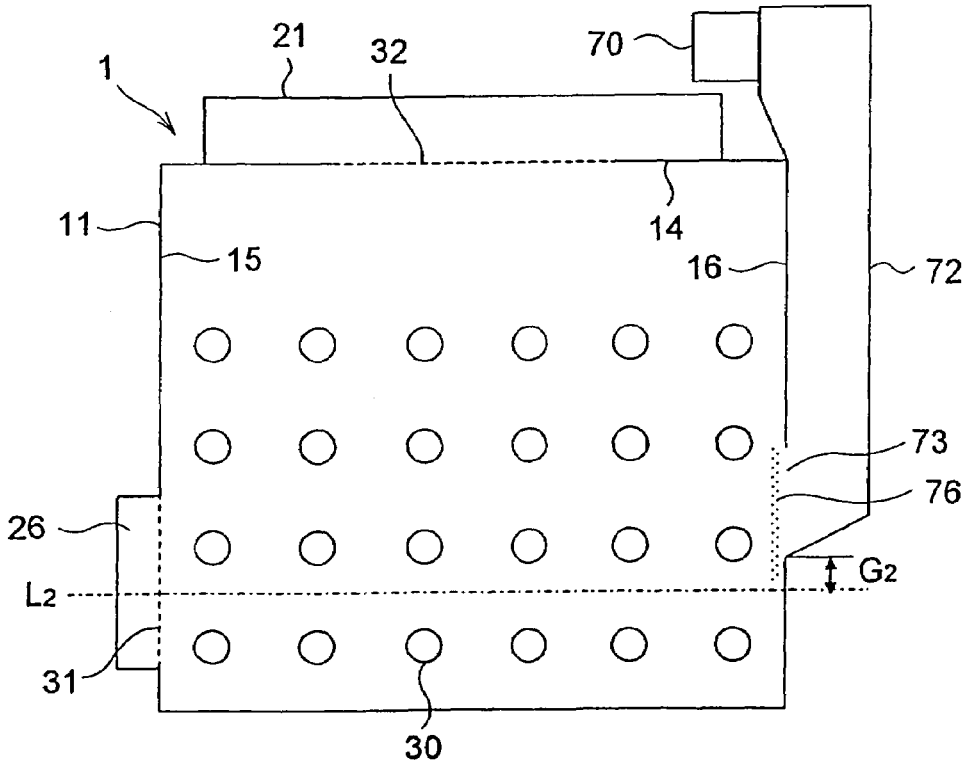
FIG. 10 is a schematic horizontal sectional view showing a ninth embodiment of a cooking oven according to the invention.

FIG. 10 shows a ninth embodiment of a cooking oven according to the invention. This embodiment also is characterized by the position of the wave feed port 73. The wave feed port 73 is formed in the side inner wall that faces the one (the left inner wall 15) in which the side blowout port 31 is formed, specifically, in the right inner wall 16. The wave feed port 73 does not directly face a half or more of the horizontal width of the side blowout port 31. In the case shown in the figure, the front end of the wave feed port 73 is located a distance of $G_2$ inside the horizontal-direction center (indicated by line $L_2$) of the side blowout port 31.

In this way, the side blowout port 31 and the wave feed port 73 are deviated horizontally from each other so as not to directly face each other. This reduces the risk of the hot air stream that blows out from the side blowout port 31 sprinkling the wave feed port 73 with pollutants, and thus reduces the risk of pollutants starting fire or causing electric discharge.

Figure 11:
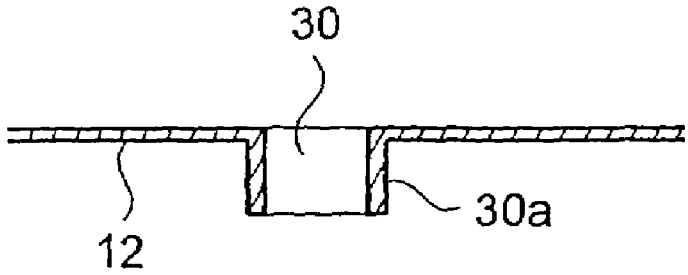
FIG. 11 is a partial horizontal sectional view showing a tenth embodiment of a cooking oven according to the invention.
Figure 12:
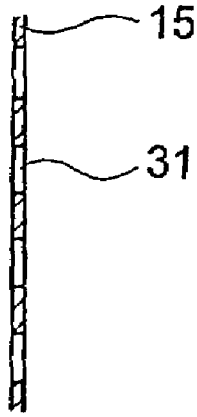
FIG. 12 is a partial vertical sectional view showing, along with FIG. 11, the tenth embodiment of a cooking oven according to the invention.

FIGS. 11 and 12 show a tenth embodiment of a cooking oven according to the invention. The tenth embodiment proposes a construction that applies generally to cooking ovens having an upper blowout port 30 and a side blowout port 31, each formed by a plurality of perforations, formed in a cooking chamber 11. This construction is applicable irrespective of whether there is provided a turntable 50 or not, and irrespective of how the perforations of the upper blowout port 30 are sized, combined, and distributed.

In the tenth embodiment, the perforations of the upper blowout port 30 are given, as shown in FIG. 11, an axial-direction length that is equal to or greater than the thickness of the member forming the ceiling wall 12. In other words, they are given a shape like a nozzle. Such a shape can be obtained easily by subjecting sheet metal to burring or swaging. In the case of the perforations described earlier as having a diameter of 11 mm, a cylindrical portion 30*a* is formed around the rim of each perforation, and this cylindrical portion 30*a* projects about 2 mm from the base metal. It may project farther than that. The cylindrical portion 30*a* projects toward the interior of the cooking chamber 11.

On the other hand, the perforations of the side blowout port 31 are given, as shown in FIG. 12, an axial-direction length that is about equal to or smaller than the thickness of the member forming the left inner wall 15. In a case where the member forming the left inner wall 15 is sheet metal, such a shape can be obtained easily by punching. Even if punching produces small burrs on one side of the sheet metal, they are within the range "about equal to the thickness of the member." After punching, pressing may additionally be performed to make the rims of the perforations as thick as or thinner than the base metal.

In this construction, the hot air stream that blows out from the upper blowout port 30 forms a stream in the form of beams and collides with the foods 60 without diminishing its flow speed. This permits the hot air stream to exert powerful impact. On the other hand, the hot air stream that blows out from the side blowout port 31 starts to spread as soon as it exits from the side blowout port 31. This weakens the impact that the hot air stream exerts when it hits the foods 60, permitting the hot air stream to enclose widely and softly the side and bottom faces of the foods 60.

This makes it possible to more effectively exploit the characteristics of different cooking methods, as both in cooking employing a hot-air-impingement method whereby a high-speed hot air stream is blown down from the upper blowout port 30 and in preparation of sponge cake in which a higher weight is given to a hot air stream that blows out from the side blowout port 31.

Figure 13:
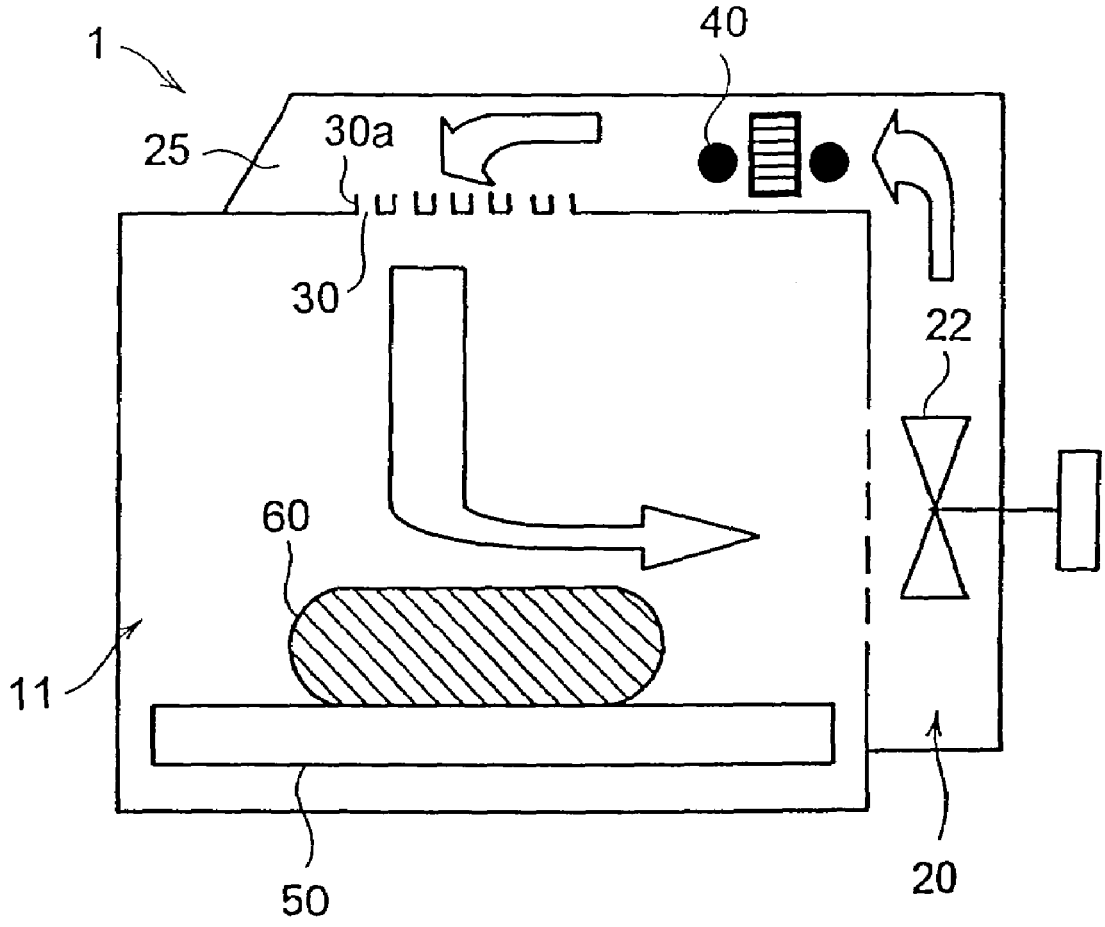
FIG. 13 is a schematic vertical sectional view of an eleventh embodiment of a cooking oven according to the invention.
Figure 14:
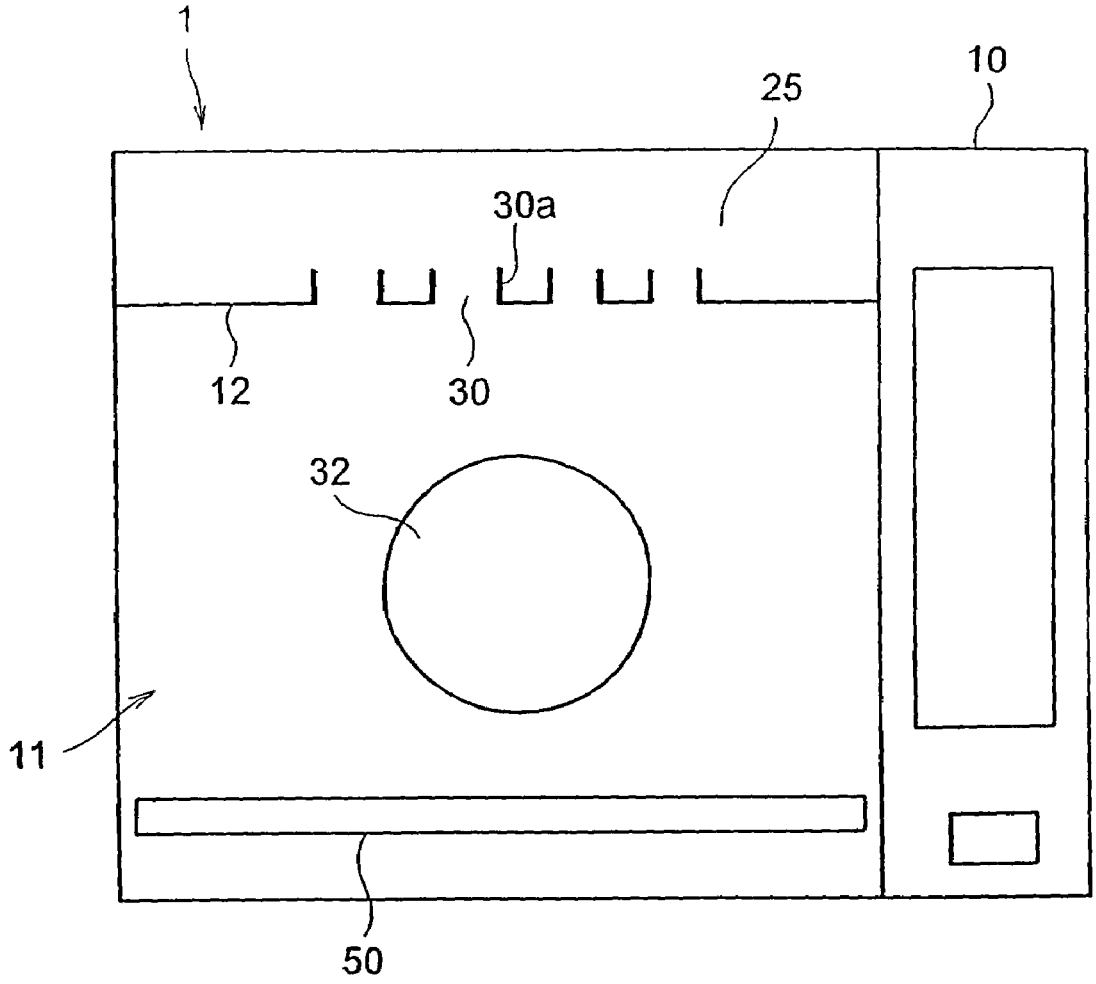
FIG. 14 is another schematic vertical sectional view of the eleventh embodiment of a cooking oven according to the invention, as seen from a direction perpendicular to FIG. 13.

FIGS. 13 and 14 show an eleventh embodiment of a cooking oven according to the invention. The eleventh embodiment is a partially modified version of the tenth embodiment. Specifically, the cylindrical portion 30*a* of the perforations of the upper blowout port 30 project not toward the interior of the cooking chamber 11 but to outside.

In this construction, no projections are formed on the lower surface of the ceiling wall 12, and thus the lower surface of the ceiling wall 12 is flat. This makes cleaning of the interior of the cooking chamber 11 easy. Moreover, there is no risk of the user's fingers being injured by being caught by a cylindrical portion 30*a*.

It should be understood that the embodiments of the present invention described hereinbefore are merely examples of constructions according to the invention, and are not meant to limit the scope of the invention in any way; that is, many further modifications and variations are possible in carrying out the invention within the concept of the invention.

INDUSTRIAL APPLICABILITY

As described above, according to the present invention, in a cooking oven whose cooking chamber is provided with an upper blowout port through which a hot air stream is blown out in a vertical direction and a side blowout port through which a hot air stream is blown out in a horizontal direction, the construction is such that the vertical-direction air stream does not hinder the horizontal-direction air stream. The construction is also such that uneven heating from one part to another of foods placed on a turn table is reduced. The construction is also such that no pollutants settle and accumulate at a wave feed port through which a microwave is introduced. In addition, the construction is such that the vertical-direction air stream is given a sufficient flow speed while the horizontal-direction air stream is kept effective. These features contribute to enhancing the cooking performance of cooking ovens for business and household use.

The invention claimed is:

1. A cooking oven that has a plurality of blowout ports and a suction port for passage of hot air streams produced inside a cooking chamber so as to be capable of forming circulating air streams of the hot air and that is capable of discharging a microwave into the cooking chamber so that foods are cooked with heat by an effect of the hot air stream or the microwave alone or by a combined effect of the hot air stream and the microwave, wherein an upper blowout port for blowing out the hot air stream is formed in a ceiling wall of the cooking chamber, a side blowout port for blowing out the hot air stream is formed in one of inner side walls forming four sides of the cooking chamber, a suction port for sucking in the hot air streams is formed in one of inner side walls other than the side inner wall in which the side blowout port is formed, a wave feed port for discharging the microwave into the cooking chamber is formed in one of inner side walls other than the inner side wall in which the side blowout port is formed, the upper blowout port is so arranged that the hot air stream that blows out therefrom does not deflect downward the hot air stream that flows from the side blowout port to the foods, and the wave feed port for discharging the microwave into the cooking chamber is so arranged as not to directly face the side blowout port.

2. The cooking oven according to claim 1, wherein the wave feed port is arranged in one of inner side walls other than the inner side wall in which the side blowout port is formed and in such a way that a lower end of the wave feed port is located above a height-direction center of the side blowout port.

3. The cooking oven according to claim 1, wherein the wave feed port is arranged in a inner side wall facing the inner side wall in which the side blowout port is formed and in such a way that the wave feed port does not directly face half or more of a horizontal width of the side blowout port.

4. A cooking oven that has a plurality of blowout ports and a suction port for passage of hot air streams produced inside a cooking chamber so as to be capable of forming circulating air streams of the hot air and that is capable of discharging a microwave into the cooking chamber so that foods are cooked with heat by an effect of the hot air stream or the microwave alone or by a combined effect of the hot air stream and the microwave, wherein an upper blowout port for blowing out the hot air stream is formed in a ceiling wall of the cooking chamber, a side blowout port for blowing out the hot air stream is formed in one of inner side walls forming four sides of the cooking chamber, a suction port for sucking in the hot air streams is formed in one of inner side walls other than the side inner wall in which the side blowout port is formed, a wave feed port for discharging the microwave into the cooking chamber is formed in the inner side wall in which the side blowout port is formed, and the upper blowout port is so arranged that the hot air stream that blows out therefrom does not deflect downward the hot air stream that flows from the side blowout port to the foods.

* * * * *